US006000258A

United States Patent [19]

Lesko

[11] Patent Number: 6,000,258

[45] Date of Patent: Dec. 14, 1999

[54] BRAILLE AND ARABIC MEMORY KEY AND LOCK

[76] Inventor: Joseph John Lesko, 3419 Via Lido Ste 204, Newport Beach, Calif. 92663

[21] Appl. No.: 08/965,291

[22] Filed: Nov. 6, 1997

[51] Int. Cl.[6] ..... E05B 19/24

[52] U.S. Cl. ..... 70/460; 434/113; 40/634; 70/408; 70/438

[58] Field of Search ..... 70/408, 460, 438; 40/330, 634; 434/113

[56] References Cited

U.S. PATENT DOCUMENTS

| | | | |
|---|---|---|---|
| 1,692,686 | 11/1928 | Nichols | 40/330 |
| 1,816,642 | 7/1931 | Fetter | 40/330 |
| 1,892,995 | 1/1933 | Nicholson | 40/330 |
| 1,979,960 | 11/1934 | Coughlin | 40/330 |
| 2,065,468 | 12/1936 | Keil | 40/330 |
| 3,536,017 | 10/1970 | Lucas | 70/445 |
| 5,339,664 | 8/1994 | Mellor | 70/460 |
| 5,522,243 | 6/1996 | Kusmiss | 70/446 |
| 5,664,446 | 9/1997 | Kusmiss | 70/330 |
| 5,753,350 | 5/1998 | Bright | 428/195 |

FOREIGN PATENT DOCUMENTS

| | | | |
|---|---|---|---|
| 483070 | 1/1970 | Switzerland | 70/460 |
| 800121 | 8/1958 | United Kingdom | 70/460 |
| 806773 | 12/1958 | United Kingdom | 40/330 |

OTHER PUBLICATIONS

Popular Science p. 205, Jan. 1948.
Popular Science p. 128, Jul. 1943.

*Primary Examiner*—Darnell M. Boucher
*Attorney, Agent, or Firm*—Stetina Brunda Garred & Brucker

[57] ABSTRACT

A key 10 and lock 20 are disclosed for use and can be identified by knocking-out area 17 or breaking of tab 14 for identification of what numbered, lettered or Braille key goes with what lock.

8 Claims, 4 Drawing Sheets

BRAILLE AND ARABIC MEMORY KEY AND LOCK

FIELD OF THE INVENTION

This invention relates generally to a lock and key. The lock and key are constructed so that operator can easily identify which key goes with what lock. A previous lock and key could not be identified without going through buying expensive punches; and color-coded plastic covers for key-tops. Braille locks and keys are unknown until now.

BACKGROUND OF THE INVENTION

Locks and keys are well-known since Medieval times.

SUMMARY OF THE INVENTION

It is therefore an object of this invention to provide for the world a simple way to I.D. each lock and key. After watching a lot of foreign movies at the University of California at Irvine, Calif., I have noticed that all countries use Arabic numbers, and the "Braille" style is also used throughout the world.

BRIEF DESCRIPTION OF THE DRAWINGS

The accompanying drawings illustrate the invention. In such drawings.

DETAILED DESCRIPTION OF THE PREFERRED EMBODIMENT

Figure 1:
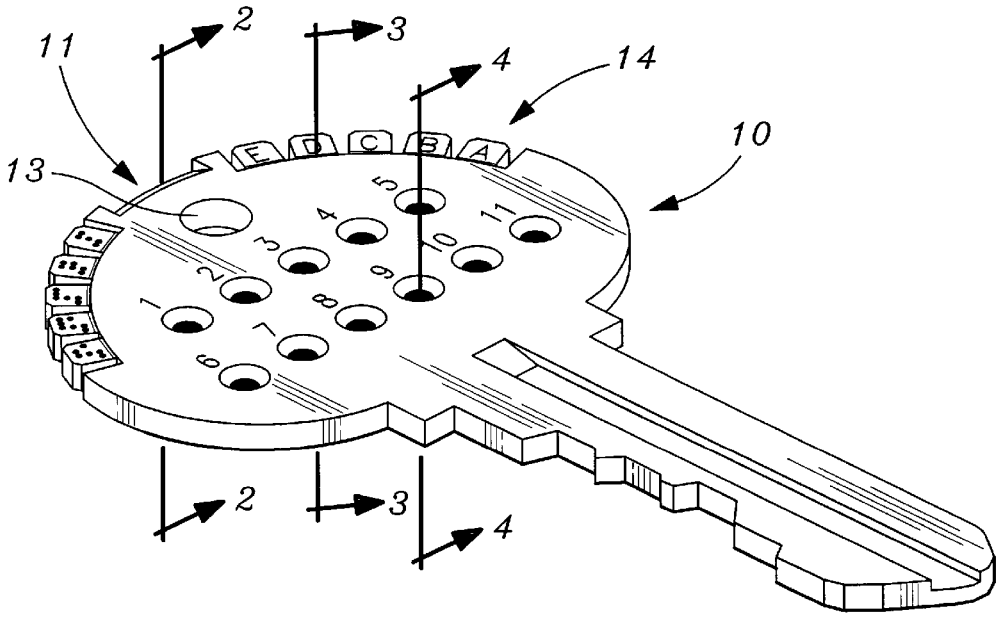
FIG. 1 is a perspective view of a key according to this invention with knock-out holes and break-off tabs.
Figure 2:
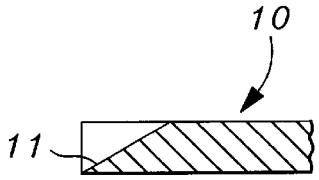
FIG. 2 shows a knife-edge to open a key-ring for insertion into a key-ring.
Figure 3:
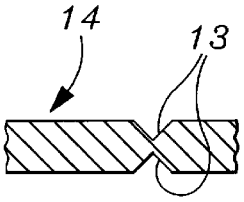
FIG. 3 shows "V" in key to break off tab or tabs.

The key 10 of the present invention is shown in FIG. 1 with knock-out holes 17 not yet punched. Number 2 is a knife-edge which is used to open a key ring for securing key to key ring. Number 12 is the key-ring hole. Number 13 shows "V's" stamped into key so when a tab 14 is broken off to I.D. a key 10, it breaks off easily and clean.

Figure 4:
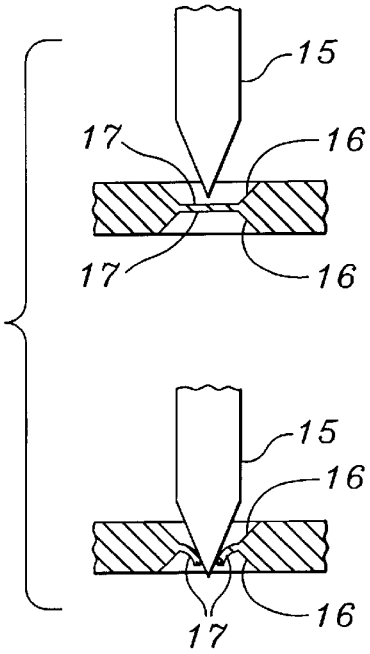
FIG. 4 shows knock-out hole and nail piercing key knock-out hole.

Nail or punch 15 penetrates 17 as shown in FIG. 4. Chamber 16 prevents getting fingers cut when 17 is punched. Chamber 16 and area 17 are symmetrical so when key 10 is laid down on a surface and punched, there is clearance for the nail-point and the Burrs. All keys are made of brass so that all operations from manufacturing to punching a hole and breaking off tabs 14 are easily performed.

Figure 6:
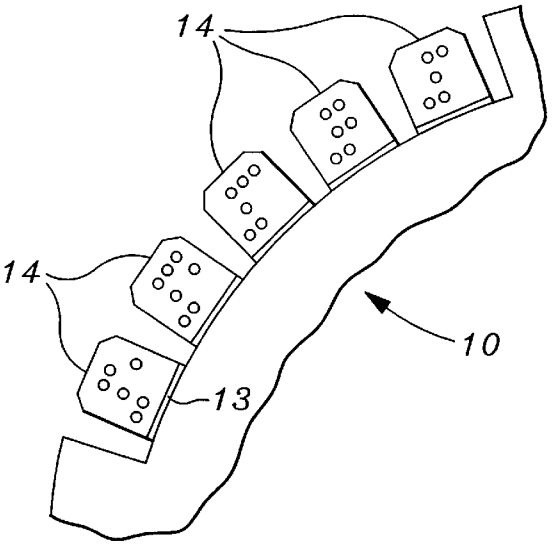
FIG. 6 is an exploded view of FIG. V showing break-off tabs for blind people.

I am a State of California, school-taught, tool-and-die maker and plastic injection, die-cast mold maker. I know that this operation is simple. A blind person can break off a tab 14, since A through J are the same as Arabic numbers I through O; the only difference is that the backwards "L" shows it's a number. My friend Peggy Harrison used to care for blind people, and she states that I.D. of keys was always a problem for blind people; getting front door locks and dead bolts mixed up with back door locks and dead bolts. One blind person had several storage boxes in the garage area of their apartment with several locks securing the storage containers. FIG. 6 is an exploded view of Braille numbered break-off tabs 14.

Referring to FIGS. 1–6, it will be apparent that the Braille numbered break-off tabs 14 attached to the key 10 may be selectively detachable to form a plurality of alternate configurations, wherein each configuration of the tabs 14 may correspond to an identifiable matching lock 20. For example, when there are multiple number of keys 10 with matching locks 20, a blind person may selectively detach the tabs 14 to form a configuration identifiable by the creation of the remaining tab(s) and/or the Braille indicia formed on the remaining tab(s).

Figure 7A:
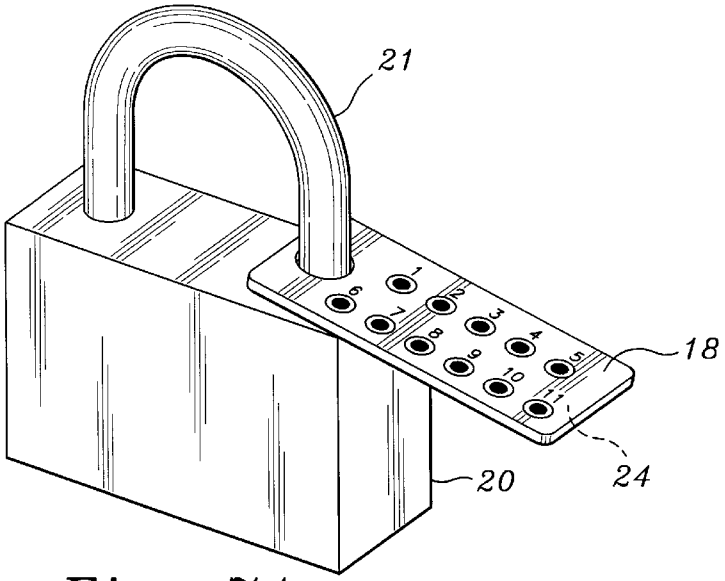
FIG. 7A shows a lock with knock-out plate attached to lock staple.
Figure 7B:
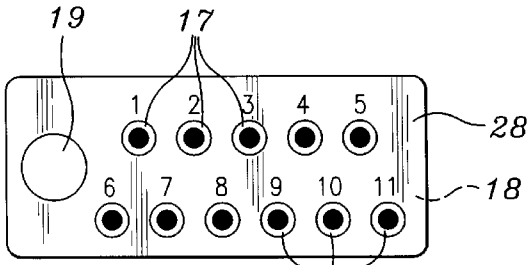
FIG. 7B shows top-plan view of knock-out plate with staple hole.

The knock-out plate 18 of the present invention is show in FIG. 7A. Hole 19 enables operator to attach knock-out plate 18 to lock 20. Knock-out areas 17 and knock-out chamber 16 are symmetrical so that the number 28 always is visible. Operator does not have to turn over plate 18 for I.D.

Figure 5:
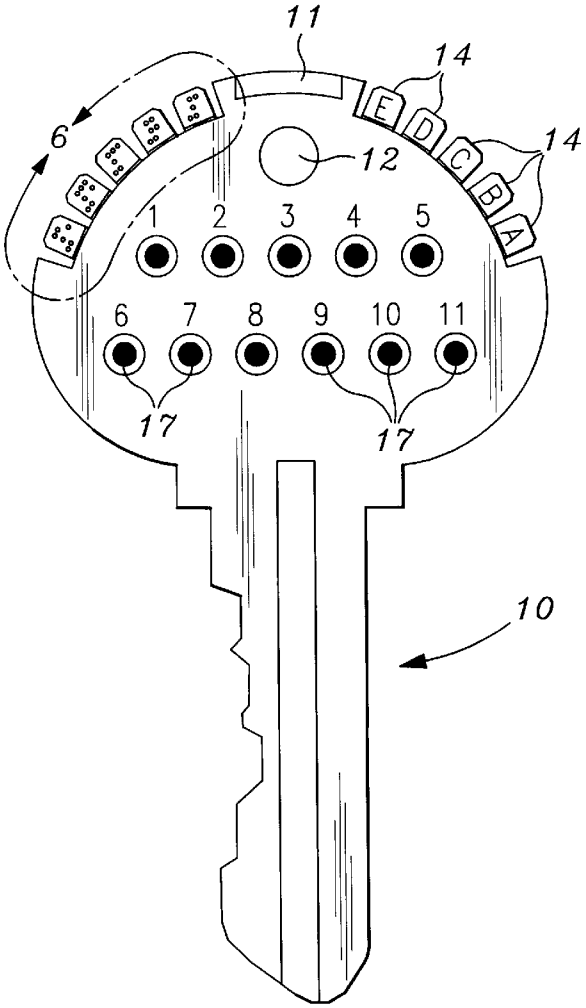
FIG. 5 shows top plan view of key.

Referring to FIGS. 1–5 in view of FIGS. 7A–9, the present invention may further be useful to visually enabled persons. As seen in FIG. 5, the key 10 further comprises a knock-out area 17 having punchable numbered holes arranged in predetermined order. Furthermore, as seen in FIG. 7A, the matching lock 20 further comprises a knock-out plate 18 having punchable numbered holes arranged in predetermined order. When a numbered hole of the knock-out area 17 and the knock-cut plate 18 are punched, the punched hole of the knock-out area 17 is numerically identical to the punched hole of the knock-out plate 18. The numerically identical punched holes are representative of correspondence between the key 10 and the matching lock 20. The same number may be indicated by the configuration of tabs 14. Therefore, a visually enabled person may visually identify the appropriate key 10 compatible to a matching lock 20, whereby the present key 10 and lock 20 system is useful for visually enabled persons, and thereby facilitates assistance to visually impaired persons.

Figure 8A:
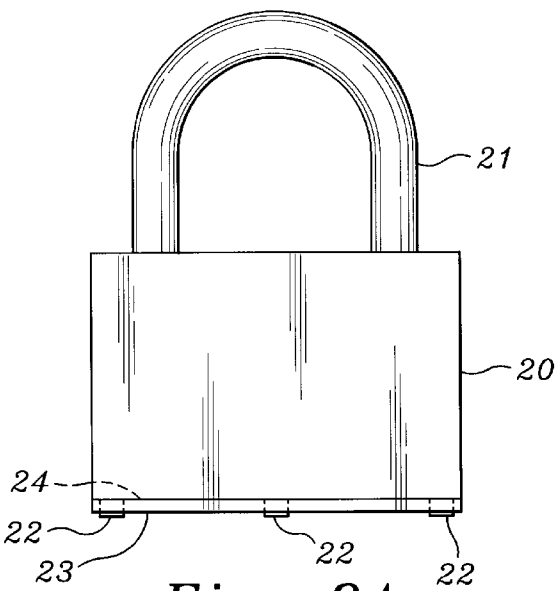
FIG. 8A is a side-elevation view of lock with knock-out plate riveted to bottom of lock.
Figure 8B:
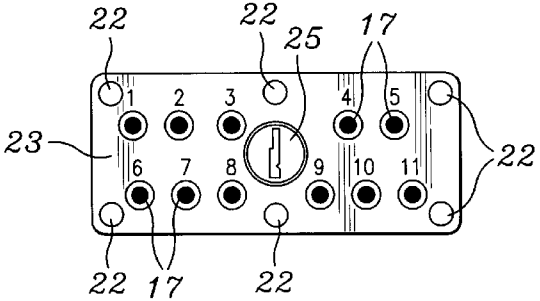
FIG. 8B is a bottom plan view of lock with knock-out plate attached.

The knock-out plate 23 of the present invention is shown in FIG. 8B. It, plate 23, is symmetrical on the other side, also. The symmetry enables assembly persons at lock factory to be error free when plate 23 is riveted to lock 20. Also, being symmetrical, when area 17 is to be punched with nail 15, there is relief for breakthrough of nail 15 and broken brass, thermoplastic, thermoset polymer, or any other suitable element, mixture or compound.

Figure 9:
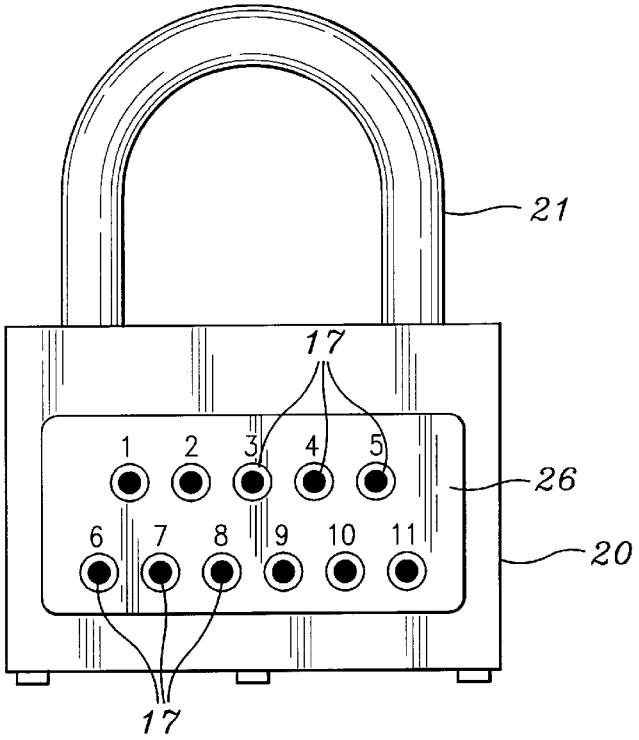
FIG. 9 is a side-elevation view of the lock with knock-out plate attached.
Figure 10:
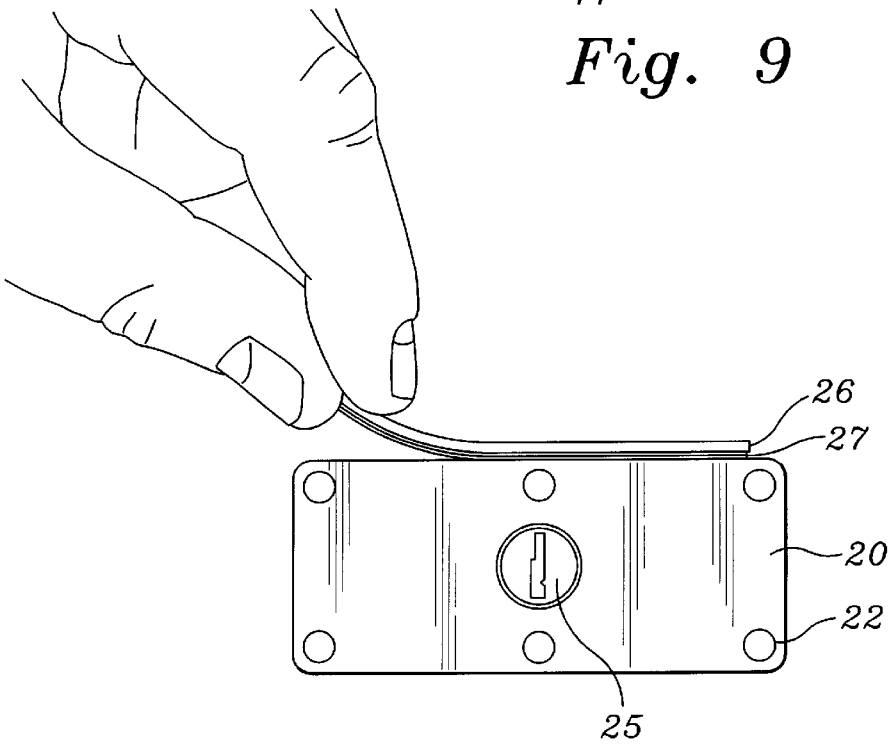
FIG. 10 is a bottom view of lock with knock-out plate being adhered to side of lock with double-back adhesive tape.

The plate 26 of the present invention is shown in FIG. 9 and attached to lock 20 by an adhesive 27 on the underside. One can purchase adhesive plate 26 at a retail outlet. One can peel off adhesive protector and adhere to lock 20. Plate 26 is symmetrical so that nail 15 has relief when puncturing area 17. Also at assembly during manufacturing of plate 26, error is omitted because of symmetry. Numbers 17 are raised or embossed on plate 18, knock-out plate 26 or on key 10.

I claim:

1. A memory key and lock system for facilitating association of a key with a corresponding lock, by visually abled and visually impaired users, the system comprising:

a key having a plurality of selectively detachable tabs formed along the periphery thereof such that remaining tabs form a plurality of alternate configurations, the tabs having tactile inscriptions formed thereon;

the key further having a key visual indicator conformed thereon; and a lock corresponding to the key, the lock having a lock visual indicator formed thereon.

2. The invention as set forth in claim 1 wherein said tabs are detachable such that the tactile inscriptions on the remaining tabs correspond to the lock visual indicator.

3. The invention as set forth in claim 1 wherein the tabs are formed to have a knock-out chamfer along the length thereof such that the tabs are detachable by application of finger pressure upon the tabs.

4. The invention as set forth in claim 1 wherein the key visual indicator comprises a knock-out area having punchable numbered holes arranged in predetermined order.

5. The invention as set forth in claim 4 wherein the lock visual indicator comprises a knock-out plate having punchable numbered holes arranged in predetermined order.

6. The invention as set forth in claim 5 wherein the knock-out area numbered holes and the knock-out plate numbered holes are punchable to correspond with each other, and with the tactile inscriptions on the remaining tabs.

7. The invention as set forth in claim 6 wherein the plate is attachable to the lock.

8. The invention as set forth in claim 6 wherein the plate further comprises an adhesive formed on the plate to attach the plate to the lock.

* * * * *